US009740144B2

(12) United States Patent
Ohtani

(10) Patent No.: US 9,740,144 B2
(45) Date of Patent: Aug. 22, 2017

(54) CLEANING DEVICE AND IMAGE FORMING APPARATUS

(71) Applicant: FUJI XEROX CO., LTD., Minato-ku, Tokyo (JP)

(72) Inventor: Hideyuki Ohtani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/703,095

(22) Filed: May 4, 2015

(65) Prior Publication Data

US 2015/0234327 A1 Aug. 20, 2015

Related U.S. Application Data

(63) Continuation of application No. 13/044,034, filed on Mar. 9, 2011, now Pat. No. 9,116,469.

(30) Foreign Application Priority Data

Jul. 16, 2010 (JP) ..... 2010-161204

(51) Int. Cl.
*G03G 15/16* (2006.01)

(52) U.S. Cl.
CPC ..... *G03G 15/161* (2013.01)

(58) Field of Classification Search
CPC ..... G03G 15/0886; G03G 15/0865; G03G 21/1832; G03G 21/1619; G03G 21/105; G03G 2221/1684
See application file for complete search history.

(56) References Cited

U.S. PATENT DOCUMENTS

| | | | | |
|---|---|---|---|---|
| 7,383,001 | B2 | 6/2008 | Fukao | |
| 2005/0180773 | A1 | 8/2005 | Morimoto et al. | |
| 2006/0045561 | A1 | 3/2006 | Takayama et al. | |
| 2006/0140673 | A1* | 6/2006 | Kamimura | G03G 15/01 399/119 |
| 2006/0216057 | A1 | 9/2006 | Fukao | |
| 2007/0003316 | A1* | 1/2007 | Fujiwara | G03G 21/0029 399/101 |

(Continued)

FOREIGN PATENT DOCUMENTS

| | | | |
|---|---|---|---|
| JP | 2001272865 | A | 10/2001 |
| JP | 2005070509 | A | 3/2005 |

(Continued)

OTHER PUBLICATIONS

Japanese Office Action dated Sep. 3, 2013, issued in corresponding Japanese Patent Application No. 2010-161204.

(Continued)

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A cleaning device includes a cleaning device body including a cleaning member, the cleaning member being in contact with a surface of an image carrier so as to remove developer retained on the surface of the image carrier; and a fixing member that fixes an end of the cleaning device body in a longitudinal direction to a side surface of a frame that supports the image carrier and corresponds to the end of the cleaning device body in the longitudinal direction.

8 Claims, 7 Drawing Sheets

(56) References Cited

U.S. PATENT DOCUMENTS

| | | | | |
|---|---|---|---|---|
| 2007/0189802 | A1* | 8/2007 | Maeda | G03G 15/161 399/101 |
| 2008/0298833 | A1* | 12/2008 | Kimura | G03G 15/161 399/101 |
| 2009/0226205 | A1 | 9/2009 | Sato et al. | |
| 2010/0028041 | A1 | 2/2010 | Sakuma | |

FOREIGN PATENT DOCUMENTS

| | | | |
|---|---|---|---|
| JP | 2006301545 | A | 11/2006 |
| JP | 2009116119 | A | 5/2009 |

OTHER PUBLICATIONS

Chinese Office Action dated Nov. 4, 2014 issued in corresponding Chinese Patent Application No. 201110085002.1.

Communication dated Jun. 5, 2017 from the State Intellectual Property Office of the P.R.C. in counterpart application No. 201510125670.0.

* cited by examiner

CLEANING DEVICE AND IMAGE FORMING APPARATUS

CROSS-REFERENCE TO RELATED APPLICATIONS

This application is a continuation application of U.S. application Ser. No. 13/044,034, filed on Mar. 9, 2011 which is based on and claims priority under 35 USC 119 from Japanese Patent Application No. 2010-161204 filed Jul. 16, 2010.

BACKGROUND

The present invention relates to a cleaning device and an image forming apparatus.

SUMMARY

According to an aspect of the invention, there is provided a cleaning device including a cleaning device body including a cleaning member, the cleaning member being in contact with a surface of an image carrier so as to remove developer retained on the surface of the image carrier; and a fixing member that fixes an end of the cleaning device body in a longitudinal direction to a side surface of a frame that supports the image carrier and corresponds to the end of the cleaning device body in the longitudinal direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the accompanying drawings.

Figure 1:
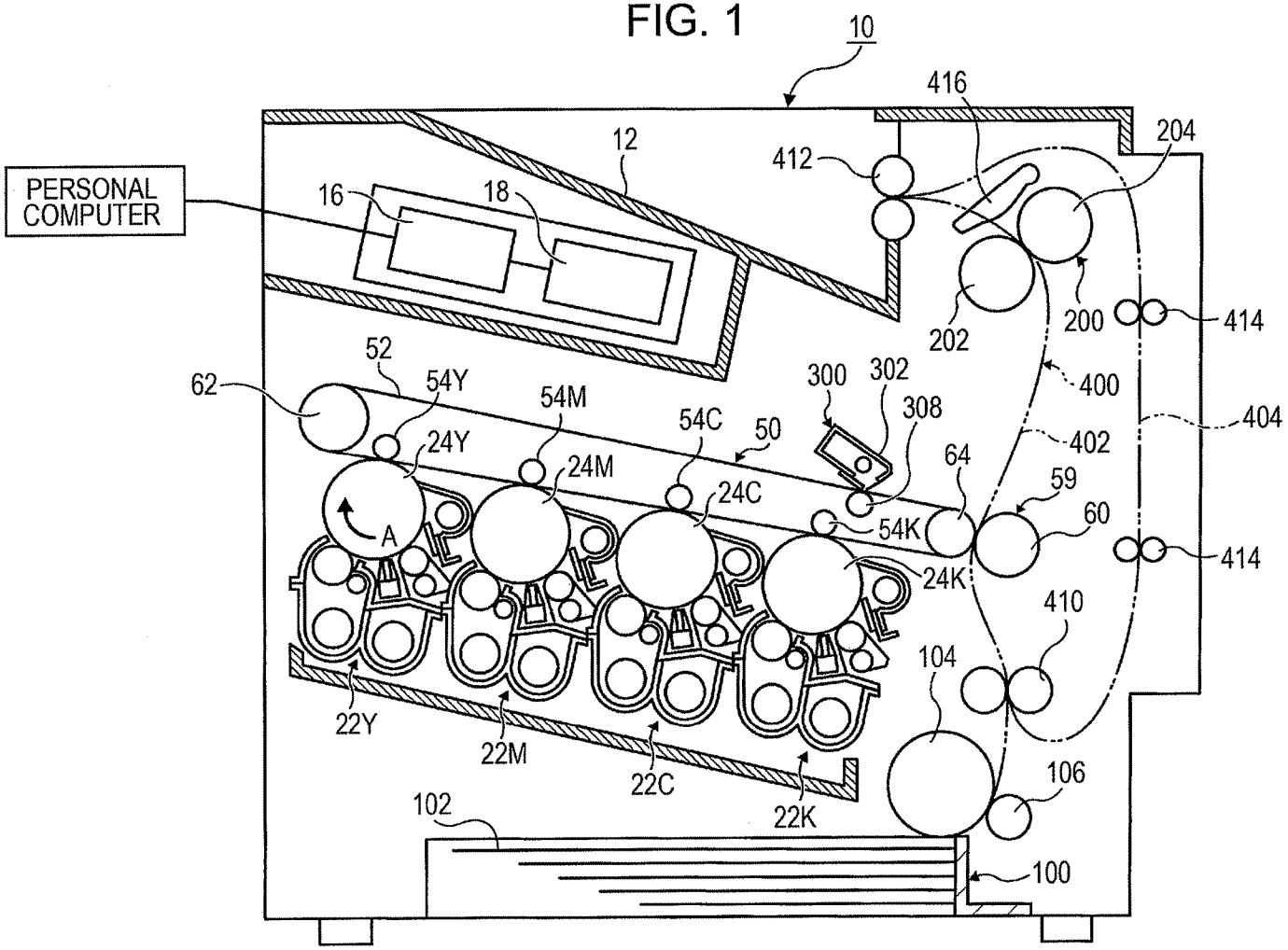
FIG. 1 is a sectional front view of an image forming apparatus according to an exemplary embodiment of the present invention.

FIG. 1 illustrates an image forming apparatus 10 according to the exemplary embodiment of the present invention.

Referring to FIG. 1, the image forming apparatus 10 includes an image processing unit 16 and a control unit 18. The image processing unit 16 receives image data transmitted from, for example, a personal computer (PC) or an image reading device (not shown), and subjects the image data to predetermined image processes, such as shading correction, misregistration correction, brightness/color-space conversion, gamma correction, frame erasing, and color and movement editing as necessary. The control unit 18 controls the overall operation of the image forming apparatus 10.

The image forming apparatus 10 includes four image forming units 22Y, 22M, 22C, and 22K, an intermediate transfer device 50, a sheet feeding device 100, a fixing device 200, and a cleaning device 300 for an intermediate transfer body. A transport path 400 along which a sheet of paper is transported is formed in the image forming apparatus 10. An upper section of the image forming apparatus 10 is used as an ejection unit 12 to which the sheet is ejected after an image is formed thereon.

The image forming units 22Y, 22M, 22C, and 22K respectively include photoconductor drums 24Y, 24M, 24C, and 24K and form a yellow developer image with yellow developer, a magenta developer image with magenta developer, a cyan developer image with cyan developer, and a black developer image with black developer. The detailed structure of the image forming units 22Y, 22M, 22C, and 22K will be described below.

The intermediate transfer device 50 includes an intermediate transfer body 52, first transfer devices 54Y, 54M, 54C, and 54K, and a second transfer device 59. The intermediate transfer body 52 serves as an image carrier that retains and transports developer applied thereto. In the present exemplary embodiment, the intermediate transfer body 52 is formed as an endless belt that is rotatably supported by multiple support rollers 62 and 64.

At least one of the support rollers 62 and 64 serves as a drive roller that transmits a driving force to the intermediate transfer body 52. The drive roller receives a driving force from a driving source (not shown), such as a motor, through a driving-force transmitting mechanism (not shown), and is thereby rotated. Accordingly, the intermediate transfer body 52 is rotated. In the present exemplary embodiment, the support roller 64 is used as a drive roller. At least one of the support rollers 62 and 64 serves as a tension roller that applies a tension to the intermediate transfer body 52. In the present exemplary embodiment, the support roller 62 is used as a tension roller.

The first transfer devices 54Y, 54M, 54C, and 54K include first transfer rollers 56Y, 56M, 56C, and 56K (see FIG. 2) to which a first transfer bias is applied, and transfer the developer images formed on the surfaces of the photoconductor drums 24Y, 24M, 24C, and 24K onto the intermediate transfer body 52.

The second transfer device 59 includes a second transfer roller 60, and functions as a transfer device that transfers the developer retained by the intermediate transfer body 52 onto a sheet.

The fixing device 200 includes a heating roller 202 that heats the sheet and a pressing roller 204 that presses the sheet against the heating roller 202.

The sheet feeding device 100 includes, for example, a single sheet-storing unit 102 that stores sheets used as recording media in a stacked manner, a sending-out roller 104 that sends out the sheets stored in the sheet-storing unit 102, and a retard roller 106 used to prevent the sheets from being fed in an overlapping manner.

The transport path 400 includes a first transport path 402 and a reverse transport path 404. The first transport path 402 allows a sheet to be transported from the sheet feeding device 100 to the second transfer device 59 and ejected from the second transfer device 59 to the ejection unit 12. The above-described sheet feeding device 100, registration rollers 410, the above-described second transfer device 59, the above-described fixing device 200, and ejection rollers 412 are arranged along the first transport path 402 in that order from the upstream side in the direction in which the sheet is transported.

The registration rollers 410 catch a leading edge of a sheet that is transported toward the second transfer device 59 and temporarily stop the movement thereof toward the second transfer device 59. The registration rollers 410 release the leading edge of the sheet and allow the sheet to start moving toward the second transfer device 59 in synchronization with the time at which a portion of the intermediate transfer body 52 onto which the developer images have been transferred reaches the position of the second transfer device 59.

The ejection rollers 412 transport the sheet to which the developer images have been fixed by the fixing device 200 toward the ejection unit 12. The ejection rollers 412 are capable of rotating in either direction so that the sheet may be transported in either a direction toward the ejection unit 12 or a direction from the ejection unit 12 toward the reverse transport path 404.

The reverse transport path 404 is used to reverse a sheet having an image formed on one side thereof. The reverse transport path 404 allows the sheet to be transported from the ejection rollers 412 to a position upstream of the registration rollers 410. Two pairs of reverse transport rollers 414 and 414, for example, are arranged along the reverse transport path 404. A guide member 416 that guides the sheet is provided between the ejection rollers 412 and the fixing device 200. The guide member 416 is movable between a position at which the guide member 416 guides the sheet from the fixing device 200 toward the ejection rollers 412 and a position at which the guide member 416 guides the sheet from the ejection rollers 412 toward the reverse transport path 404.

When the sheet having an image formed on one side thereof is to be subjected to a process for forming an image on the other side thereof, the rotational direction of the ejection rollers 412 is reversed while a trailing edge of the sheet having an image formed on one side thereof is in contact with the ejection rollers 412. Accordingly, the sheet is guided toward the reverse transport path 404 with the edge that has been the trailing edge serving as the leading edge. Thus, the sheet is transported to the registration rollers 410.

The cleaning device 300 for the intermediate transfer body 52 is used to remove the developer from the surface of the intermediate transfer body 52. The cleaning device 300 is disposed downstream of the second transfer device 59 and upstream of the first transfer device 54Y, which is located most upstream, in the moving direction (rotational direction) of the intermediate transfer body 52. The cleaning device 300 includes a cleaning device body 302 arranged at the outer side of the intermediate transfer body 52 (side on which the developer is retained) and a backing member 308 arranged at the inner side of the intermediate transfer body 52 and opposed to the cleaning device body 302. The cleaning device body 302 is located obliquely below the fixing device 200 and is placed in a space between the fixing device 200 and the intermediate transfer body 52. The space between the fixing device 200 and the intermediate transfer body 52 is often left unused as a dead space. Since the cleaning device body 302 is disposed in this space, the size of the image forming apparatus 10 is reduced accordingly.

The detailed structure of the cleaning device 300 for the intermediate transfer body 52 will be described below.

Figure 2:
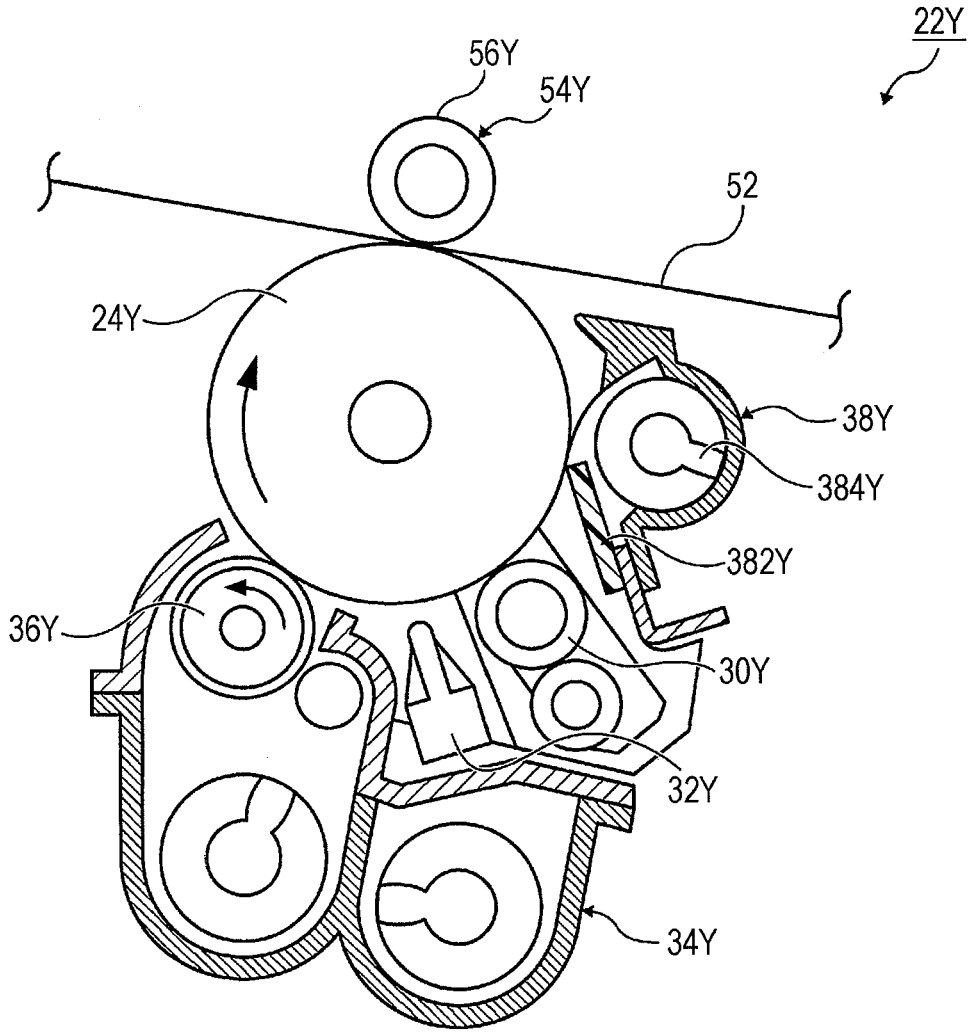
FIG. 2 is a sectional front view of an image forming unit included in the image forming apparatus illustrated in FIG. 1.

FIG. 2 illustrates the image forming unit 22Y. Although the image forming units 22M, 22C, and 22K contain developers of different colors, the structures thereof are the same as that of the image forming unit 22Y, which will be described below. Thus, explanations of the image forming units 22M, 22C, and 22K will be omitted.

As illustrated in FIG. 2, the image forming unit 22Y includes the above-described photoconductor drum 24Y, a charging device 30Y, a latent-image forming device 32Y, a developing device 34Y, and a cleaning device 38Y for the photoconductor drum 24Y. The charging device 30Y includes, for example, a charging roller, and uniformly charges the surface of the photoconductor drum 24Y. The latent-image forming device 32Y includes, for example, a light-emitting diode (LED) array. The latent-image forming device 32Y forms a latent image on the surface of the photoconductor drum 24Y by emitting light toward the surface of the photoconductor drum 24Y which has been uniformly charged by the charging device 30Y.

The developing device 34Y includes a developing roller 36Y which functions as a developer carrier. The developing roller 36Y supplies the yellow developer to the photoconductor drum 24Y, and develops the latent image formed on the surface of the photoconductor drum 24Y with the yellow developer. The cleaning device 38Y for the photoconductor drum 24Y includes, for example, a plate-shaped cleaning member 382Y. The cleaning member 382Y scrapes off the yellow developer that remains on the surface of the photoconductor drum 24Y after the yellow developer image has been transferred onto the intermediate transfer body 52. Thus, the photoconductor drum 24Y is cleaned. The developer removed by the cleaning member 382Y is transported to a collection unit (not shown) by a transporting member 384Y, and is collected in the collection unit.

Figure 3:
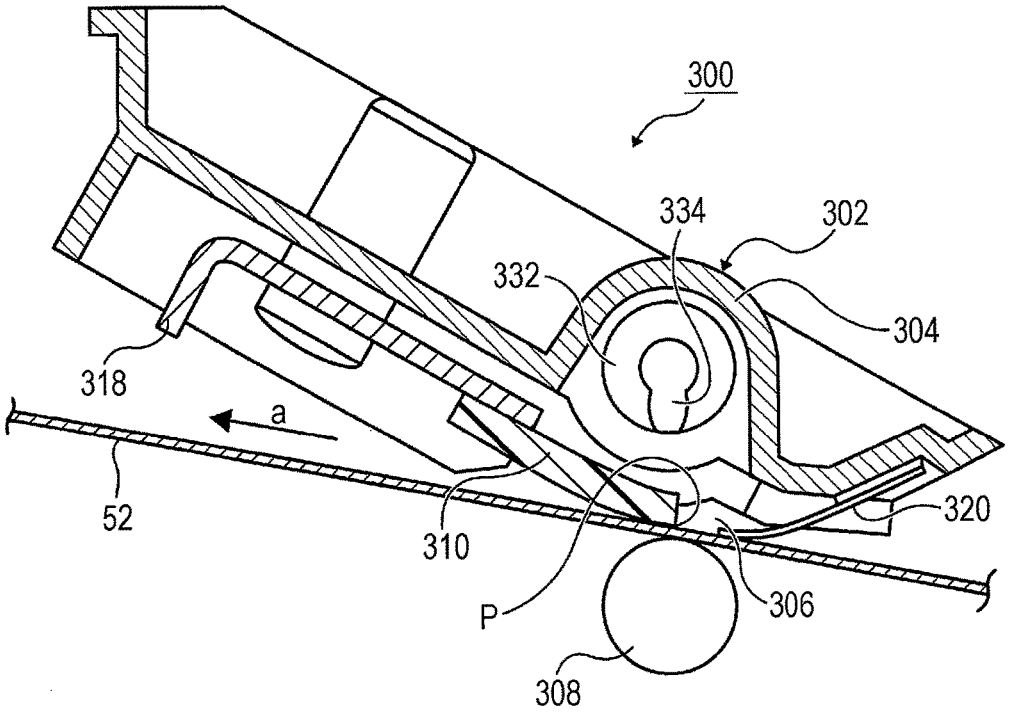
FIG. 3 is a sectional view of a cleaning device for an intermediate transfer body included in the image forming apparatus illustrated in FIG. 1.

FIG. 3 illustrates the cleaning device 300 for the intermediate transfer body 52. Arrow a in FIG. 3 shows the moving direction of the intermediate transfer body 52, that is, the direction in which the intermediate transfer body 52 transports the developer. The cleaning device body 302 includes a body frame 304 and a cleaning member 310 fixed to the body frame 304.

The body frame 304 has a collection space 332 in which the developer is collected. The collection space 332 extends in the longitudinal direction, and a transporting member 334 is provided in the collection space 332. A collection opening 306 that communicates with the collection space 332 is formed at the bottom of the body frame 304. The transporting member 334 includes a helical blade, and conveys the developer collected through the collection opening 306 toward one end of the collection space 332.

The cleaning member 310 is formed of a flexible material, such as rubber or resin. A first end of the cleaning member 310 is fixed to, for example, a support member 318 made of metal with, for example, an adhesive. The support member 318 is fixed to the body frame 304 with, for example, a screw. A second end of the cleaning member 310 faces the collection opening 306 and is in contact with the intermediate transfer body 52 at a contact position P such that an urging force is applied to the intermediate transfer body 52. The cleaning member 310 is pressed against the backing member 308 with the intermediate transfer body 52 interposed therebetween.

A sealing member 320 is, for example, a film-shaped flexible member that is disposed upstream of the cleaning member 310 in the moving direction of the intermediate transfer body 52. A first end of the sealing member 320 is fixed to the body frame 304, and a second end of the sealing member 320 faces the collection opening 306. The second end of the sealing member 320 is opposed to the second end of the cleaning member 310, and seals a gap between the collection opening 306 and the intermediate transfer body 52 so that the developer removed from the surface of the intermediate transfer body 52 by the cleaning member 310 does not leak out of the cleaning device 300.

The backing member 308 is formed of, for example, a roller that is rotated by the movement of the intermediate transfer body 52. The contact point between the backing member 308 and the intermediate transfer body 52 is opposed to the contact position P of the cleaning member 310. Accordingly, the pressing force applied to the intermediate transfer body 52 by the cleaning member 310 is determined by the positional relationship between the backing member 308 and the cleaning member 310. As the pressing force applied to the intermediate transfer body 52 by the cleaning member 310 increases, the performance of cleaning the intermediate transfer body 52 increases. However, the resistance against the intermediate transfer body 52 also increases. As the pressing force applied to the intermediate transfer body 52 by the cleaning member 310 decreases, the resistance against the intermediate transfer body 52 decreases. However, the performance of cleaning the intermediate transfer body 52 decreases, and there is a risk that the developer on the intermediate transfer body 52 cannot be sufficiently removed. The positional relationship between the backing member 308 and the cleaning member 310 is set such that the pressing force applied to the intermediate transfer body 52 by the cleaning member 310 is at an appropriate level.

Next, the fixing structure of the cleaning device 300 will be described.

Figure 4:
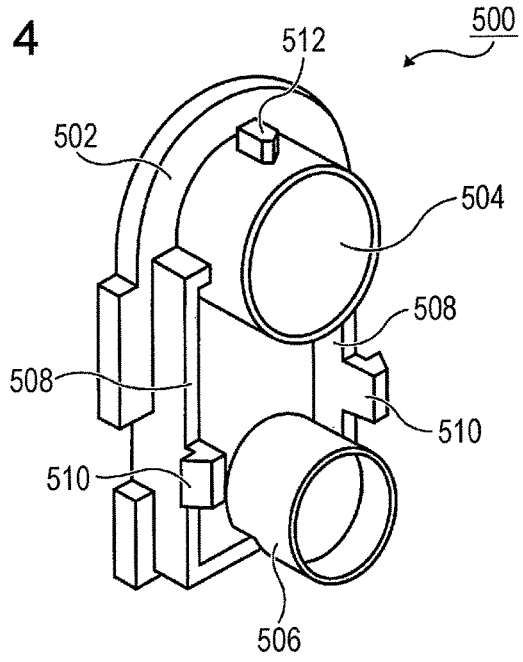
FIG. 4 is a perspective rear view of a first fixing member that fixes the cleaning device for the intermediate transfer body illustrated in FIG. 3.
Figure 5:
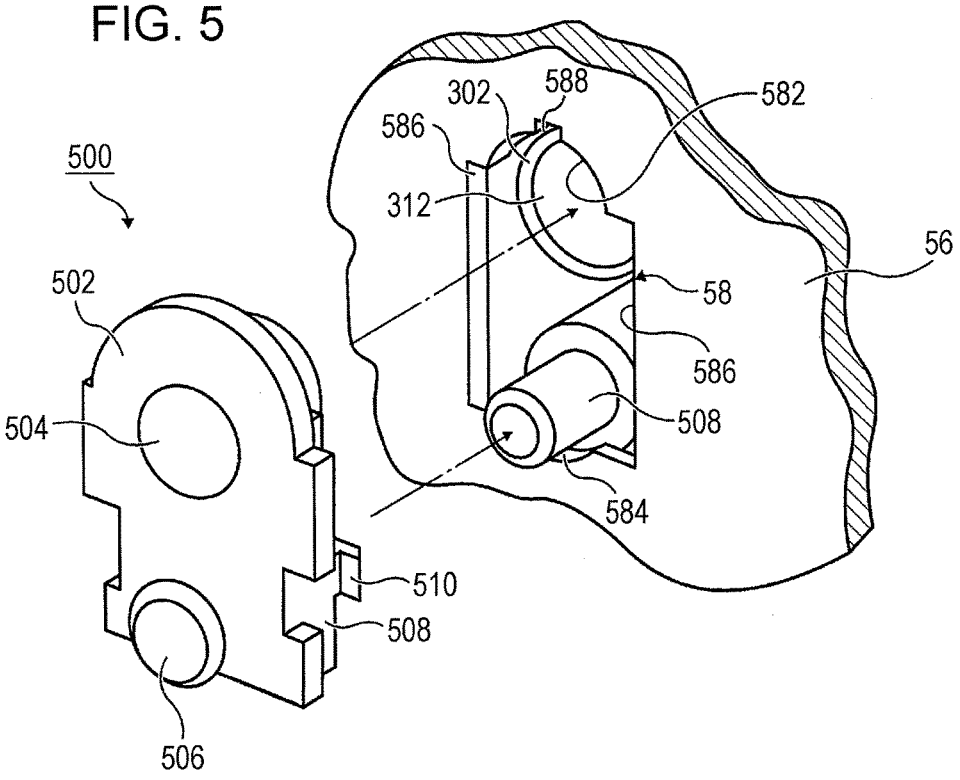
FIG. 5 is a perspective front view of the first fixing member that fixes the cleaning device for the intermediate transfer body illustrated in FIG. 3 and a part of an intermediate transfer device.
Figure 6:
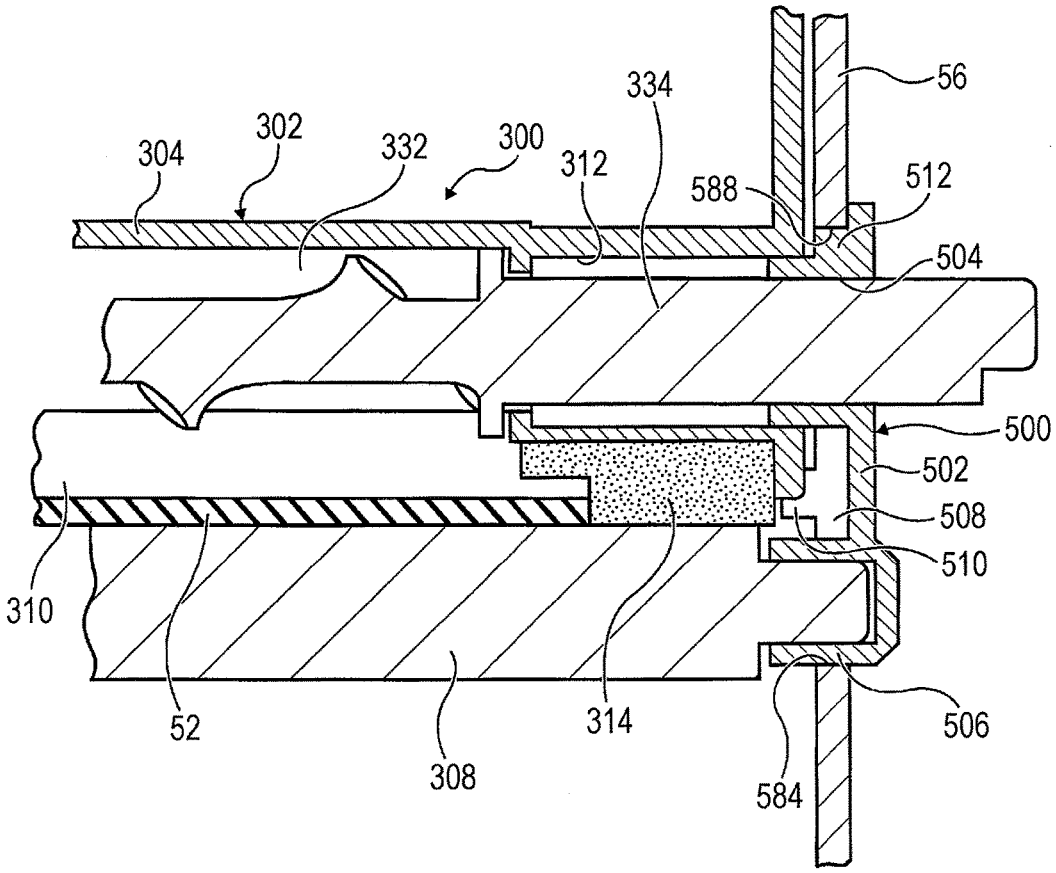
FIG. 6 is a sectional view illustrating the section in which the cleaning device for the intermediate transfer body illustrated in FIG. 3 is fixed to the intermediate transfer device with the first fixing member.

Referring to FIGS. 4 to 6, the cleaning device 300 is fixed to one of frames 56 of the intermediate transfer device 50 with a first fixing member 500. The frames 56 are provided at either side of the intermediate transfer body 52 and support the above-described support rollers 62 and 64, the first transfer devices 54Y, 54M, 54C, and 54K, and other components. The frame 56 to which the cleaning device 300 is fixed has a fixing hole 58 formed therein. The fixing hole 58 includes an upper fixing portion 582 having a semicircular shape that opens downward, a lower fixing portion 584 having a semicircular shape that opens upward, and side fixing portions 586 and 586 formed at either side of the fixing hole 58 so as to connect the upper fixing portion 582 and the lower fixing portion 584 to each other. A recess 588 that opens downward is formed at the center of the upper fixing portion 582.

The first fixing member 500 includes a base portion 502 that is plate-shaped and slightly wider than the fixing hole 58 formed in the frame 56. Two shaft bearing portions 504 and 506 are provided on the inner surface of the base portion 502. The upper shaft bearing portion 504 extends through the base portion 502 to the front side thereof. The lower shaft bearing portion 506 is closed at the deep end thereof. Rising portions 508 and 508 are also provided on the inner surface of the base portion 502 so as to rise from the base portion 502 at either side thereof. Hook portions 510 and 510 are formed on the rising portions 508 and 508 so as to project outward. A projection 512 is formed so as to project upward from the outer periphery of the upper shaft bearing portion 504 at the top end thereof.

An upper peripheral portion of the upper shaft bearing portion 504 is fitted to the upper fixing portion 582 of the fixing hole 58 in the frame 56. The projection 512 is fitted to the recess 588. A peripheral edge at an end of the upper shaft bearing portion 504 is fitted to a fitting hole 312 formed in the body frame 304. Referring to FIG. 6, an end of the transporting member 334 is inserted into the fitting hole 312, and extends through the shaft bearing portion 504 of the first fixing member 500 so as to project from the first fixing member 500. The transporting member 334 is rotatably supported by the upper shaft bearing portion 504 of the first fixing member 500. The end of the transporting member 334 that projects from the frame 56 is connected to a driving unit, such as a motor, with a transmitting unit (not shown), such as a gear, provided therebetween.

As illustrated in FIG. 6, a lower peripheral portion of the lower shaft bearing portion 506 is fitted to the lower fixing portion 584 of the fixing hole 58 in the frame 56. An end of the backing member 308 is inserted into the shaft bearing portion 506, and the backing member 308 is rotatably supported by the shaft bearing portion 506 of the first fixing member 500.

The rising portions 508 and 508 of the first fixing member 500 are fitted to the side fixing portions 586 and 586 of the fixing hole 58. The hook portions 510 and 510 have elasticity. When the first fixing member 500 is inserted into the fixing hole 58, the hook portions 510 and 510 are elastically deformed and are inserted to the inner side of the frame 56. After the insertion, the hook portions 510 and 510 restore their original shape. Thus, the frame 56 is placed between the periphery of the base portion 502 and the hook portions 510 and 510 of the first fixing member 500.

As described above, the upper shaft bearing portion 504 is fitted to the upper fixing portion 582, the projection 512 to the recess 588, the lower shaft bearing portion 506 to the lower fixing portion 584, and the rising portions 508 and 508 to the side fixing portions 586 and 586. Thus, the position of the first fixing member 500 in a plane parallel to the frame 56 is set. In addition, the frame 56 is placed between the periphery of the base portion 502 and the hook portions 510 and 510. Thus, the first fixing member 500 is positioned with respect to the frame 56 in a direction perpendicular to the frame 56.

The upper shaft bearing portion 504 of the first fixing member 500 is fitted to the fitting hole 312 in the cleaning device body 302. Thus, the cleaning device body 302 is positioned with respect to the first fixing member 500. The backing member 308 is fitted to the shaft bearing portion 506 of the first fixing member 500, and thus is positioned with respect to the first fixing member 500. In the above-described manner, the cleaning device body 302 and the backing member 308 are positioned with respect to the first fixing member 500. Therefore, the positional relationship between the cleaning member 310 fixed to the cleaning device body 302 and the backing member 308 is determined by the first fixing member 500.

Both sides of the intermediate transfer body 52 are sealed by sealing members 314 provided on the cleaning device body 302, so that the collected developer may be prevented from leaking from the sides of the cleaning device body 302.

Figure 7:
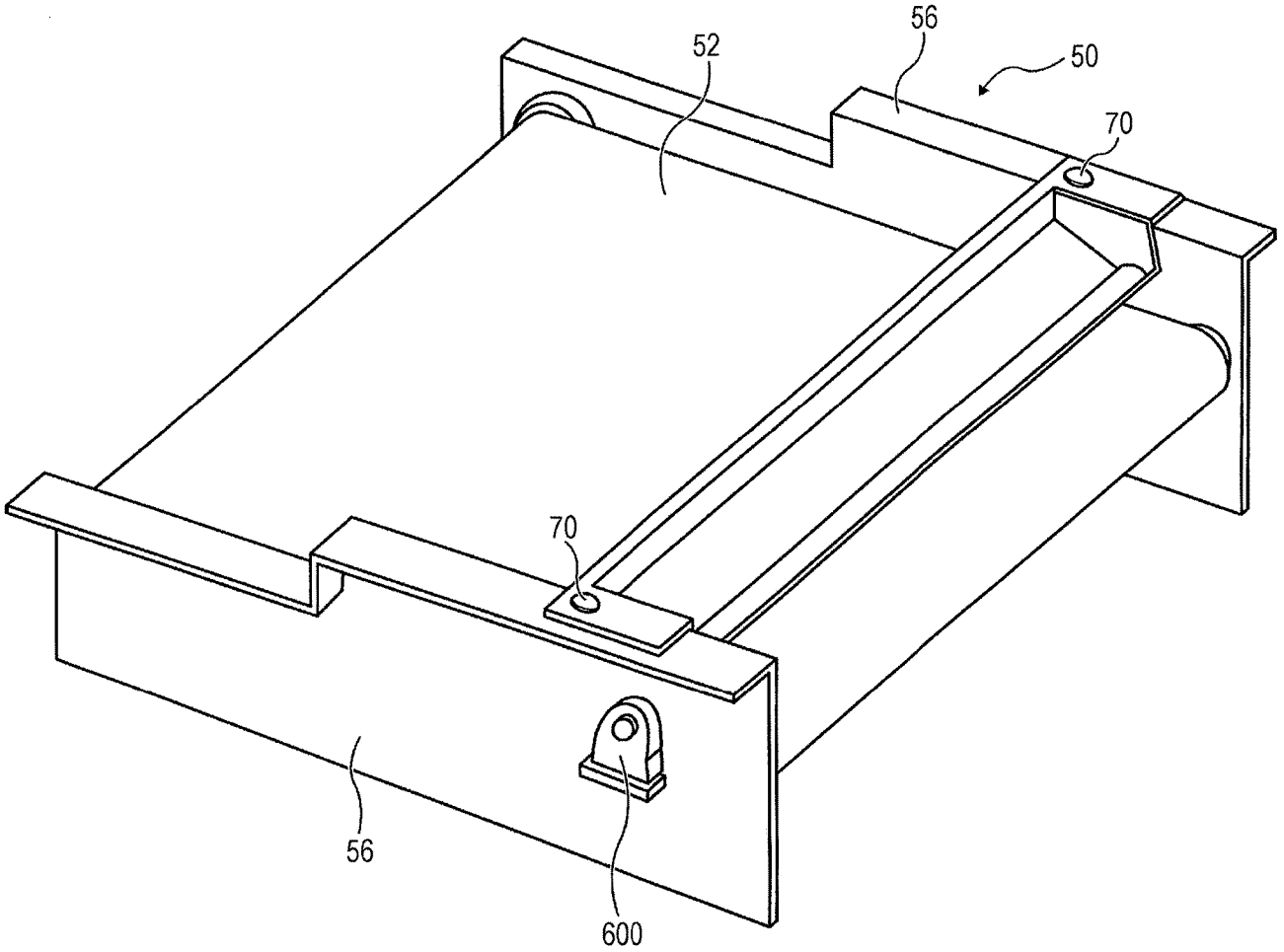
FIG. 7 is a perspective view of the intermediate transfer device illustrated in FIG. 1.

FIG. 7 illustrates the overall structure of the intermediate transfer device 50. In the intermediate transfer device 50, the intermediate transfer body 52 is supported by the frames 56 and 56 disposed at either side. The above-described cleaning device body 302 is disposed above the intermediate transfer body 52, and is fixed to the top portions of the frames 56 and 56 with screws 70 and 70. The side surfaces of the cleaning device body 302 at the ends thereof in the longitudinal direction of the cleaning device body 302 are fixed to the frames 56 and 56 with the first fixing member 500 and a second fixing member 600.

Figure 8:
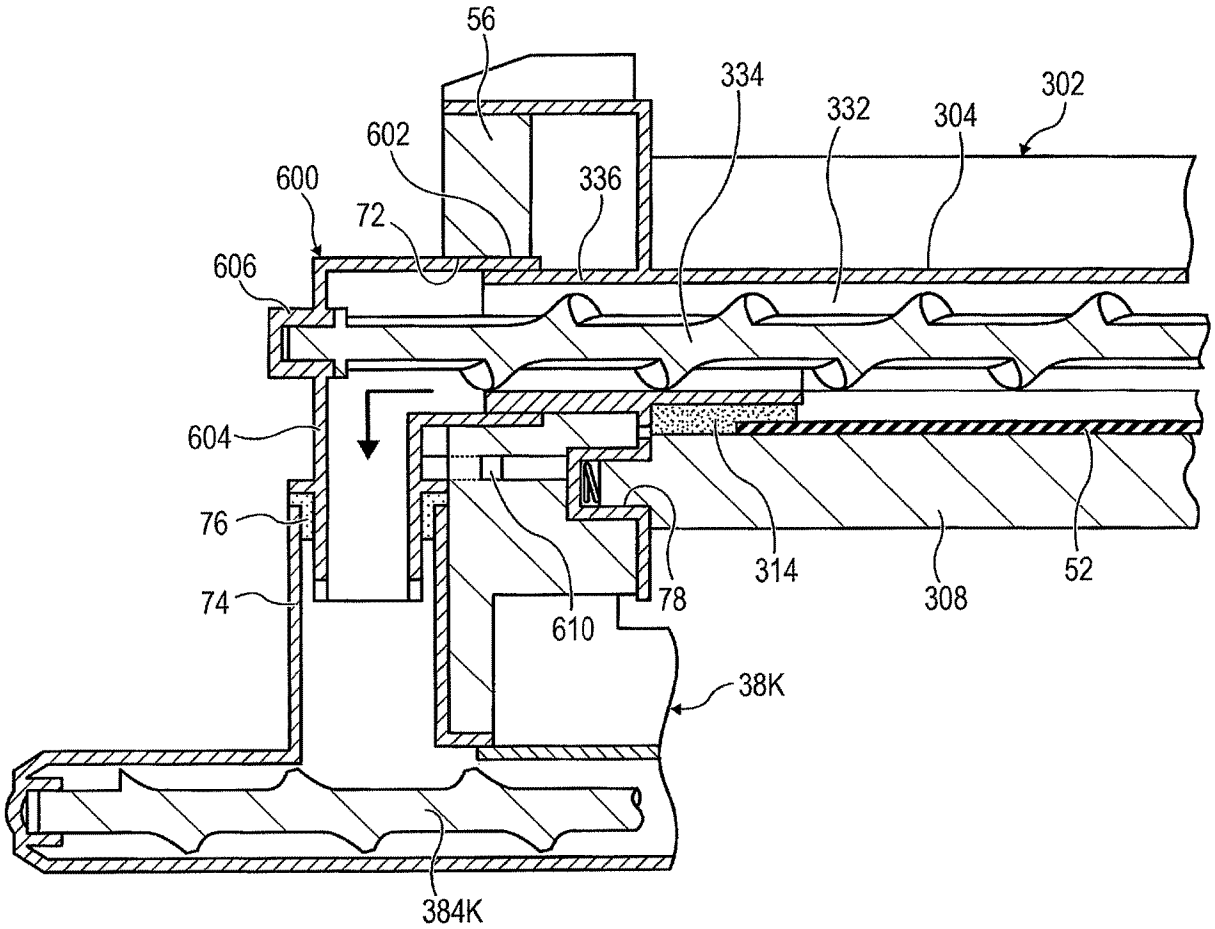
FIG. 8 is a sectional view illustrating the section in which the cleaning device for the intermediate transfer body illustrated in FIG. 3 is fixed to the intermediate transfer device with a second fixing member.

FIG. 8 illustrates the structure of the second fixing member 600. The second fixing member 600 includes an insertion portion 602 that projects toward the corresponding frame 56 and a connection portion 604 that extends downward. The insertion portion 602 is inserted into an insertion hole 72 formed in the frame 56. An insertion portion 336 formed at an end of the cleaning device body 302 in the longitudinal direction thereof is inserted into the insertion portion 602. An end of the transporting member 334 is rotatably supported by a shaft bearing portion 606 formed in the second fixing member 600. Thus, the positions of the cleaning device body 302 and the transporting member 334 on the side surface of the frame 56 are set by the second fixing member 600.

The second fixing member 600 is provided with hook portions 610 that project toward the frame 56. Similar to the hook portions 510 on the first fixing member 500, the hook portions 610 are elastically deformed when the second fixing member 600 is inserted into the frame 56, so that the second fixing member 600 may be fixed to the frame 56.

The connection portion 604 is connected to a connection portion 74 with a sealing member 76 interposed therebetween. The connection portion 74 extends upward from the cleaning device 38K included in the image forming unit 22K for forming a black image. Thus, the collection space 332 in the cleaning device body 302 is connected to the cleaning device 38K in the image forming unit 22K through the connection portion 604 of the second fixing member 600. Accordingly, the developer collected by the cleaning device 300 for cleaning the intermediate transfer body 52 is transported to the cleaning device 38K for cleaning the photoconductor drum 24K through the connection portion 604. The developer that has been transported to the cleaning device 38K is transported to a developer collection unit that is formed integrally with a developer supply unit.

An end of the backing member 308 is rotatably supported by a shaft bearing portion 78 provided on the frame 56. The above-described first fixing member 500 fixes both the cleaning device body 302 and the backing member 308. In contrast, the second fixing member 600 fixes only the cleaning device body 302, and the backing member 308 is directly positioned with respect to the frame 56 of the intermediate transfer device 50.

In FIG. 8, components that are the same as those illustrated in FIG. 6 are denoted by the same reference numerals, and explanations thereof are thus omitted.

Since a space may be provided above the frames 56 and 56, the cleaning device body 302 may be fixed to the top portions of the frames 56 and 56 with screws 70 and 70, as illustrated in FIG. 7. However, in the areas outside the side surfaces of the frames 56 and 56, there is no space for fixing the screws since other frames and the like are disposed. Accordingly, the ends of the cleaning device body 302 in the longitudinal direction thereof are fixed with the first fixing member 500 and the second fixing member 600. If the cleaning device body 302 is fixed to the side surfaces of the frames 56 and 56 with screws, there is a risk that the cleaning device body 302 will be twisted by the fastening force applied to the screws and the cleaning member 310 cannot uniformly contact the intermediate transfer body 52.

Although the cleaning member 310 is blade-shaped in the above-described exemplary embodiment, the present invention is not limited to this. For example, a brush-shaped cleaning member may be used instead.

Although the backing member 308 is roll-shaped and rotates together with the intermediate transfer body 52 in the above-described exemplary embodiment, the present invention is not limited to this. For example, a plate-shaped backing member that is stationary even when the intermediate transfer body 52 is moved may be used instead.

In addition, the cleaning device is not limited to those for cleaning the intermediate transfer body, and may be used for other types of image carriers, such as photoconductors.

As described above, the present invention is applicable to image forming apparatuses, such as a copy machine, a facsimile machine, and a printer, and cleaning devices included in the image forming apparatuses.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to retain developer; and a cleaning device body including a cleaning member, wherein the cleaning member is configured to be in contact with a surface of the image carrier so as to remove developer retained on the surface of the image carrier, wherein the cleaning member is configured to be disposed on an upper surface of the image carrier, wherein the cleaning device body is configured to be fixed to the upper surface of the image carrier by being fixed to outside surfaces of frames, the image carrier being provided between inner surfaces of the frames, and wherein the outside surfaces of the frames are surfaces opposing the inner surfaces between which the image carrier is disposed.

2. An image forming apparatus according to claim 1, wherein the cleaning device body is configured to be fixed by hooked portions disposed on the outside surfaces of the frames, and wherein hooking portions are configured to be inserted in to the hooked portions.

3. An image forming apparatus according to claim 1, wherein the hooking portions are configured to deform elastically.

4. An image forming apparatus according to claim 1, further comprising:

screws that are configured to fix the cleaning device body to a top portion of the frames from a direction of the upper surface of the image carrier.

5. An image forming apparatus according to claim 4, wherein the image forming apparatus is configured without any screws fixing the cleaning device body to the outside surfaces of the frames.

6. An image forming apparatus according to claim 1, further comprising:

a sealing member that is a film-shaped flexible member and is disposed upstream of the cleaning member in a moving direction of the image carrier.

7. An image forming apparatus comprising:

an image carrier configured to retain developer; and a cleaning device body including a cleaning member, wherein the cleaning member is configured to be in contact with a surface of an image carrier so as to remove developer retained on the surface of the image carrier, wherein the cleaning member is configured to be disposed on the upper surface of the image carrier, wherein the cleaning device body is fixed to the upper surface of the image carrier by being fixed to outside surfaces of frames, the image carrier being provided between inner surfaces of the frames, and wherein the outside surfaces of the frames are surfaces opposing the inner surfaces between which the image carrier is disposed.

8. An image forming apparatus comprising:

an image carrier configured to retain developer; and a cleaning device body including a cleaning member, wherein the cleaning member is configured to be in contact with a surface of the image carrier so as to remove developer retained on the surface of the image carrier, wherein the cleaning member is configured to be disposed on an upper surface of the image carrier, wherein the cleaning device body is configured to be fixed to the upper surface of the image carrier by being fixed with a fixing member provided on outer surfaces of frames, the image carrier being provided between inner surfaces of the frames, and wherein in a fixed position, a portion of at least one of the frames is disposed in between a portion of the fixing member and the hooking portions of the fixing member.

* * * * *